US005507432A

United States Patent [19]

Cyr

[11] Patent Number: 5,507,432

[45] Date of Patent: Apr. 16, 1996

[54] SYSTEM FOR SEPARATING CORRUGATED FIBERBOARD

[75] Inventor: Gilles D. Cyr, Eugene, Oreg.

[73] Assignee: Industrial Adhesives, Inc., Eugene, Oreg.

[21] Appl. No.: 328,858

[22] Filed: Oct. 25, 1994

[51] Int. Cl.[6] ..... B65D 17/46

[52] U.S. Cl. ..... 229/235; 229/239; 229/924

[58] Field of Search ..... 229/235, 239, 229/924, 939

[56] References Cited

U.S. PATENT DOCUMENTS

| | | | |
|---|---|---|---|
| 1,724,224 | 8/1929 | Schroeder . | |
| 2,706,076 | 4/1955 | Guyer . | |
| 3,115,292 | 12/1963 | Repking | 229/235 |
| 3,136,474 | 6/1964 | Schaus et al. | 229/235 |
| 3,276,667 | 10/1966 | Johnson et al. . | |
| 3,469,766 | 9/1969 | Nelson . | |
| 3,850,363 | 11/1974 | Jacobs . | |
| 4,091,984 | 5/1978 | McFarland | 229/235 |
| 4,398,650 | 8/1983 | Holmes et al. | 229/939 |
| 4,558,785 | 12/1985 | Gordon . | |
| 4,778,059 | 10/1988 | Martin et al. . | |
| 4,784,271 | 11/1988 | Wosaba, II et al. . | |
| 5,078,757 | 3/1992 | Steel | 229/235 |

FOREIGN PATENT DOCUMENTS

| | | | |
|---|---|---|---|
| 739305 | 7/1966 | Canada | 229/239 |

OTHER PUBLICATIONS

"Handbook of Corrugated & Solid Fiberboard Boxes", Container Corporation of America, p. 21 (1974).

*Primary Examiner*—Gary E. Elkins

*Attorney, Agent, or Firm*—Chernoff, Vilhauer, McClung & Stenzel

[57] ABSTRACT

An improved system for separating a corrugated fiberboard panel along a separation line is disclosed. A corrugated fiberboard panel has an inner liner and an outer liner with a corrugated medium sandwiched therebetween. At least two spaced-apart strings are located in the panel beneath the outer liner. The strings are located on opposite sides of a separation line defined on the panel. A pull tab is located in the outer liner, and is connected to at least one of the strings such that when the pull tab is pulled away from said panel and transverse to the separation line at least one of the strings cuts through at least a portion of the panel, and at least one of the other strings acts as a guide to define the location of the cut. The system is economical to produce and is readily incorporated in the corrugated fiberboard during its manufacture. It is also a reliable system that is easy to use.

19 Claims, 3 Drawing Sheets

SYSTEM FOR SEPARATING CORRUGATED FIBERBOARD

BACKGROUND AND SUMMARY OF THE INVENTION

The present invention relates to corrugated fiberboard and more particularly to a system for easily separating a corrugated fiberboard panel.

Corrugated containers are widely used for shipping various products to retail distributors. The retail distributor prefers a shipping container that can be neatly and easily opened and then used as a display carton. Thus, the manufacturers of shipping containers have incorporated various container-opening systems into the containers during their manufacture. One such system employs a stitched-in rip cord in a corrugated container. The rip cord uses two strings which are stitched or sewn together through all three layers of the corrugated material. The rip cord severs the container into two sections as the stitching is pulled from the container. However, the resulting two sections have ragged edges which are not suitable for a display carton.

Other container-opening systems utilize tear tapes. Some corrugated containers are made in two sections and the sections are joined together in various ways at a taped butt joint. When the tape joint is severed, the two sections of the container can be separately utilized. However, such containers are expensive and inconvenient to manufacture. It is also necessary to interrupt the corrugating process to replace the tape rolls. In addition, these containers tend to be weakened at the corner butt joint and occasionally the containers fail during their shipment. Various other container-opening systems employ tear tapes of varying widths. One such system, which employs two pressure sensitive tapes, is difficult to apply properly. The tape joints often require a fair amount of force to remove and the containers are thus difficult to open. In addition, removing the tape also results in ragged edges on the display cartons.

Other corrugated container-opening systems employ a tear strip, which is formed by perforating or precutting various ones of the inner liner, outer liner and corrugated medium. However, such a tear strip also leaves a ragged edge on its removal and tends to weaken the shipping container in which it is incorporated.

Thus, a need exists for an improved system for opening a corrugated fiberboard container that overcomes the problems of known systems.

The present invention satisfies this need with a system for separating a corrugated fiberboard panel along a separation line. A corrugated fiberboard panel has an inner liner and an outer liner with a corrugated medium sandwiched therebetween. At least two spaced-apart strings are located in the panel beneath the outer liner. The strings are located on opposite sides of a separation line defined on the panel. A pull tab is located in the outer liner, and is connected to at least one of the strings such that when the pull tab is pulled away from said panel and transverse to the separation line at least one of the strings cuts through at least a portion of the panel, and at least one of the other strings acts as a guide to define the location of the cut. The system is economical to produce and is readily incorporated in the corrugated fiberboard during its manufacture. It is also a reliable system that is easy to use.

According to another aspect of the invention, a container includes a body having a side panel interconnecting a first end panel and a second end panel. The body includes a first liner, a second liner, and a corrugated medium located therebetween. A first string extends transversely of the side panel between the first end panel and the second end panel and is located in the side panel on the second liner. The first string has a graspable end. A second guide string is located in the side panel on the second liner in spaced-apart relationship to the first string. The second string lacks a graspable end. This corrugated container thus includes a container-opening system which avoids weakening the shipping container and which is operable to transform the container into a display carton having a smooth neat edge.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
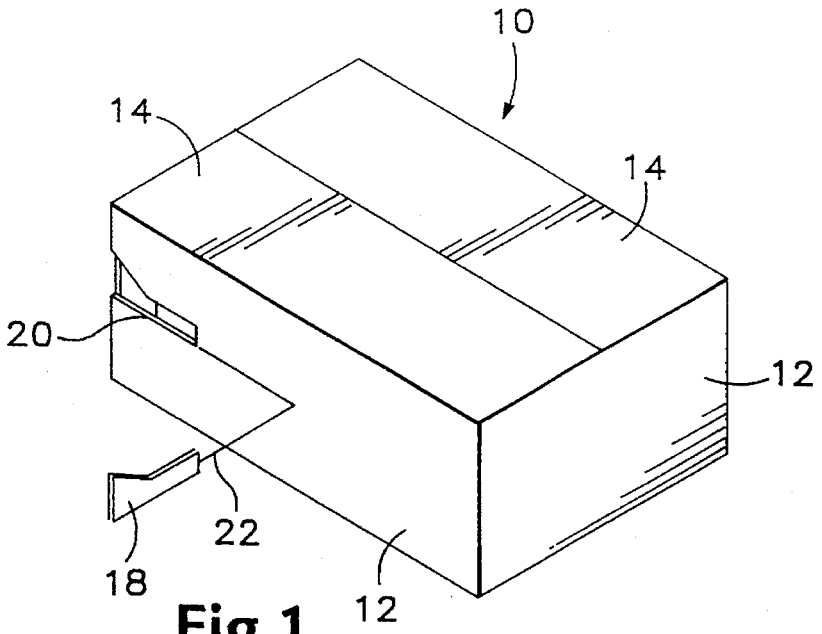
FIG. 1 is a perspective view of a container embodying the present invention.
Figure 2:
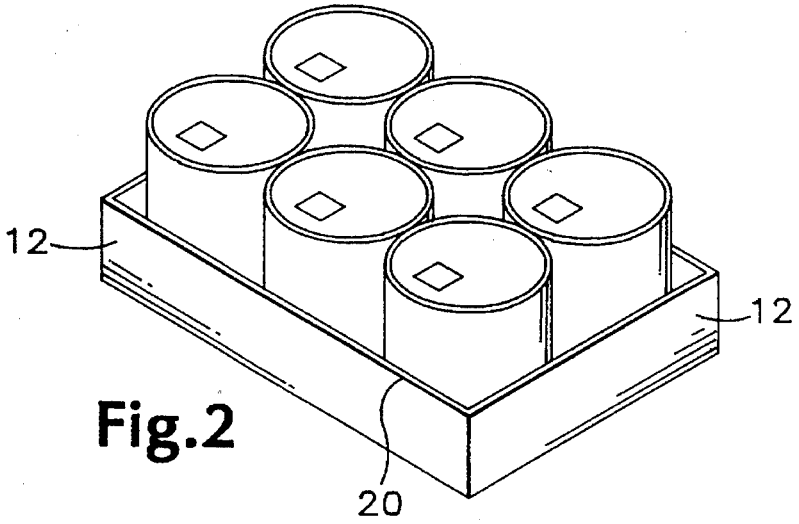
FIG. 2 is a perspective view of the container of FIG. 1 shown after the container-opening system has converted the container to a display carton.

Referring now to the drawings, a corrugated fiberboard shipping container 10 includes four side panels 12, each side panel interconnecting a top end panel 14 and a bottom end panel 16. A container-opening system includes a pull tab 18 and at least two strings 20, 22 located in the side panel operable to convert the shipping container 10 to a display carton.

Figure 3:
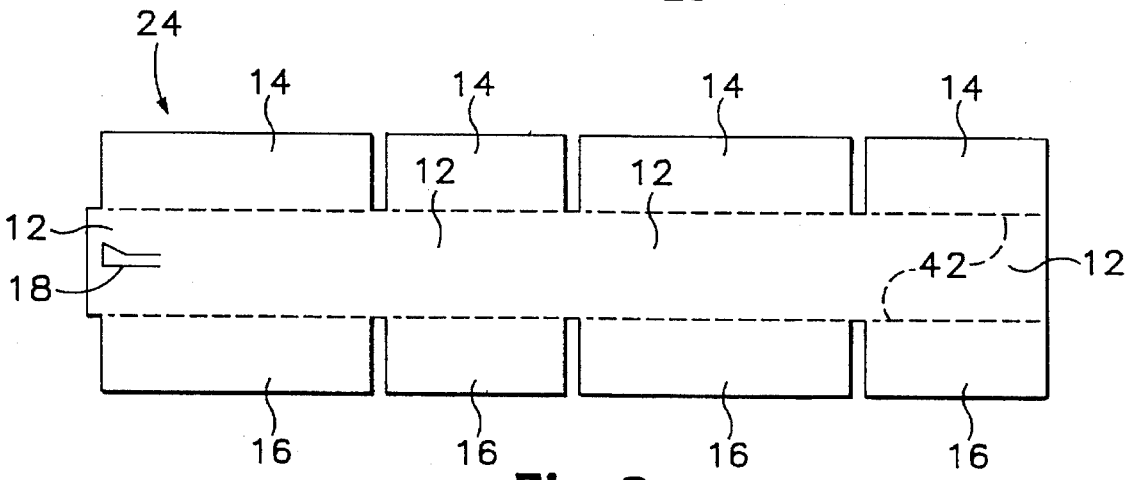
FIG. 3 is a reduced plan view of a container blank used to make the container shown in FIG. 1.
Figure 4:
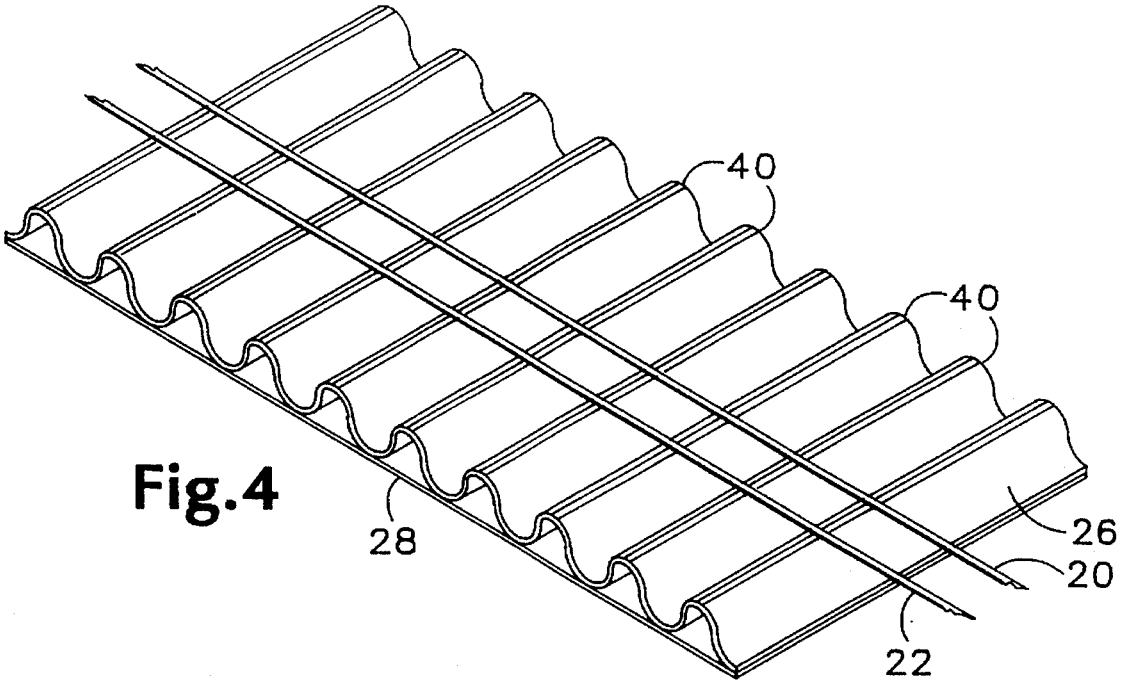
FIGS. 4–6 are perspective views of a portion of the side panel of the blank illustrating the construction of a preferred embodiment of the panel-opening system of the present invention shown at an enlarged scale.
Figure 5:
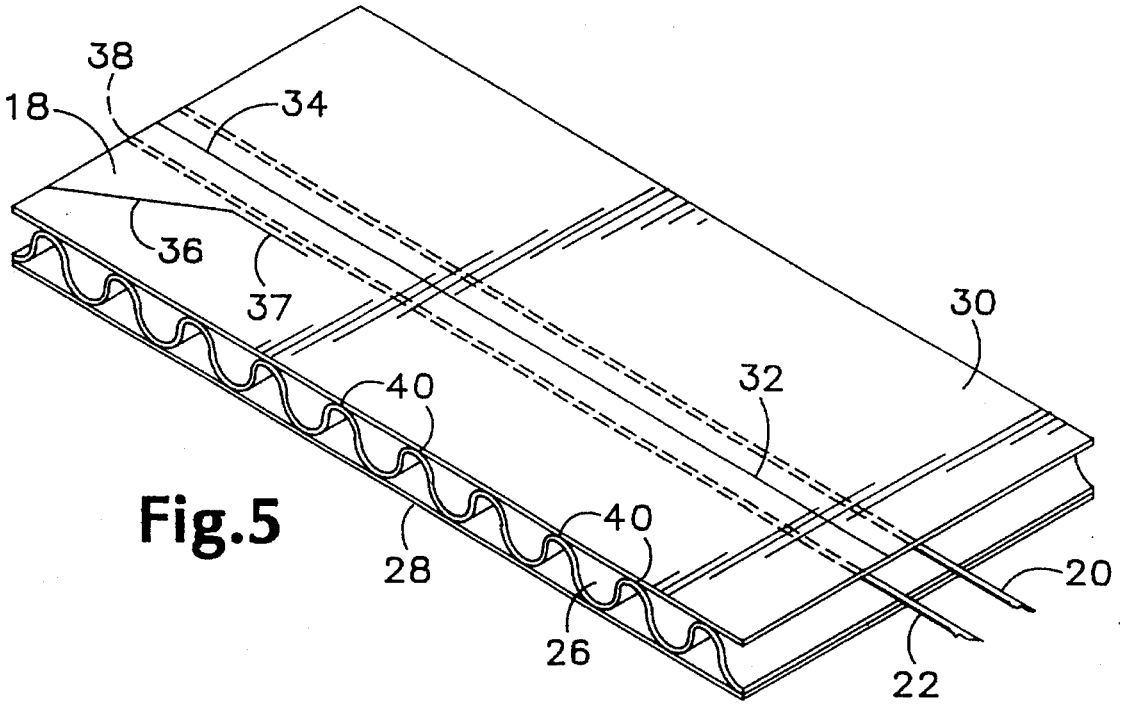
Figure 6:
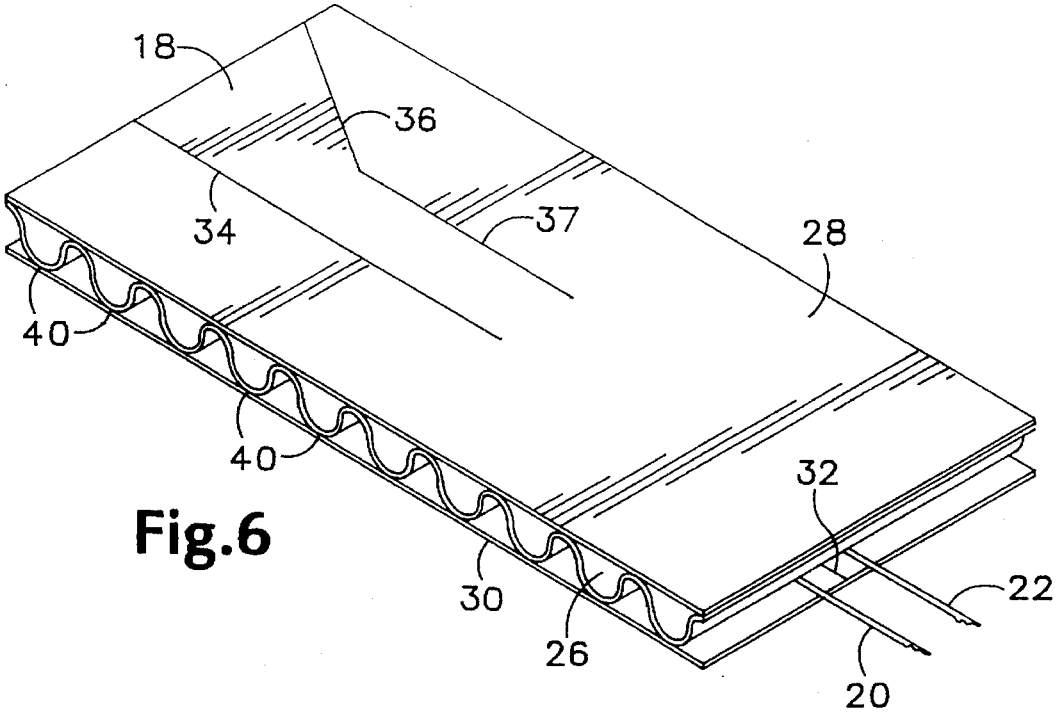

An exemplary container blank 24 (FIG. 3) suitable for constructing the container 10 is of a corrugated fiberboard construction. The blank 24 is constructed in the conventional manner with a corrugated medium 26 located between a first liner 28 and a second liner 30. The corrugated medium 26 is adhered to the first liner 28 in the usual manner to orient the corrugations to extend longitudinally between the end panels. In a preferred embodiment, at least two strings 20, 22 are applied to the corrugated medium 26 of the side panel 12 in a spaced-apart relationship (FIG. 4). The second liner 30 is adhered to the corrugated medium 26 and a line of weakness 32 is provided in the second liner between the two strings (FIG. 5). The line of weakness is a perforated line, or preferably, a continuous slit. For increased ease in opening the container, a slitting knife at the corrugator may be adjusted to also slit the ridges 40 to which the second liner 30 is adhered. In contradistinction to the usual manner of assembling a container from a fiberboard blank, the second liner preferably becomes the interior, not the exterior, of the container. Thus, fold lines 42 are added to the blank 24 and the container 10 is assembled so that the second liner 30, having the line of weakness 32, defines the interior of the container, and the first liner defines the exterior of the container. If the first and second liners are made of different quality material, the lesser quality or lower weight material is used as the second liner.

Figure 7:
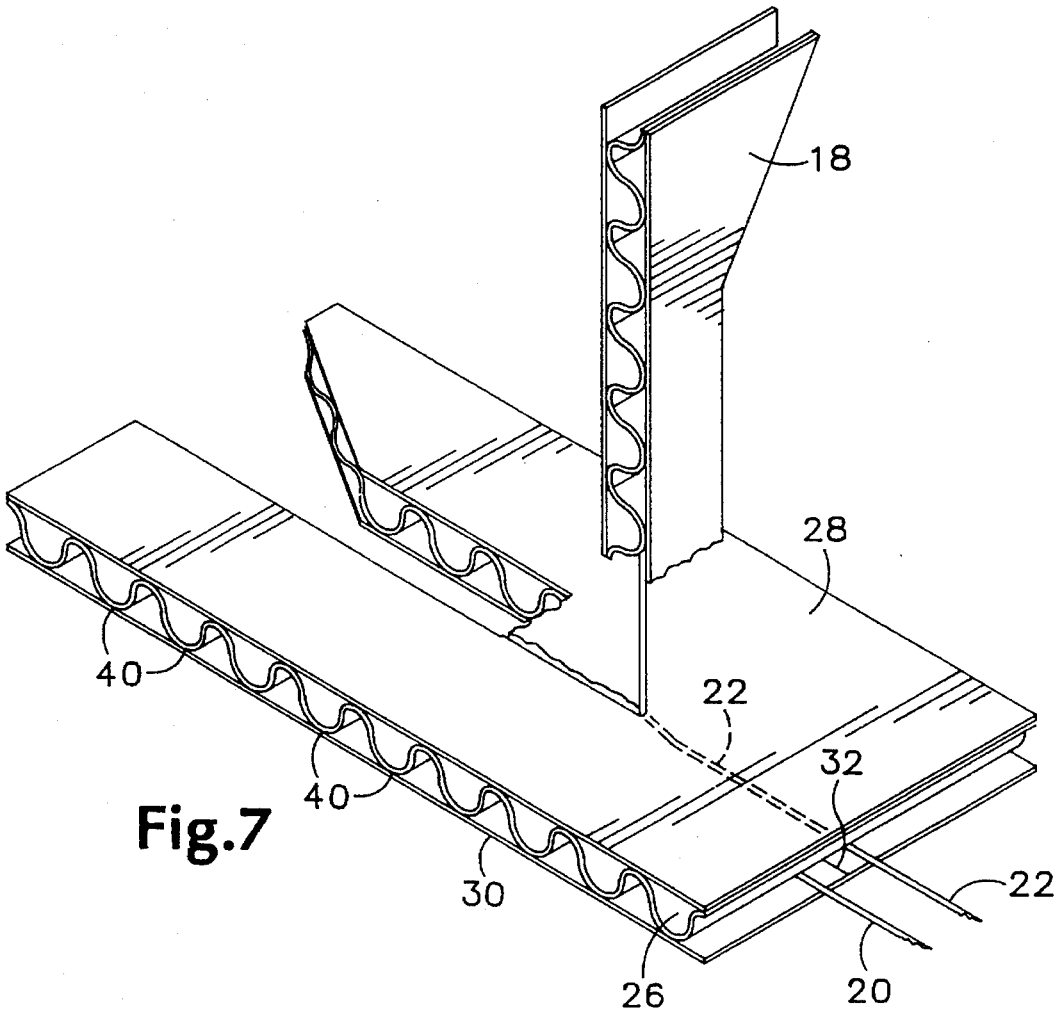
FIG. 7 is a perspective view of the portion of the container blank of FIG. 6 illustrating the operation of the panel-opening system.

A pull tab 18 is located in the container 10, preferably proximate an edge of a side panel 12. A short slit 34 that intersects all three layers of the corrugated fiberboard is located between the two strings 20, 22. The slit 34 thus corresponds in the second liner with the line of weakness 32. A second slit intersecting all three layers of fiberboard includes an angled portion 36, that is located proximate the first slit so that an end 38 of one of the strings 22 is located between the two slits 34, 36, and an aligned portion 37 that parallels the string 22. The two strings are preferably spaced apart about one-half inch along a separation line. Thus, when opening the panel 12 by pulling the pull tab 18 (FIG. 7), the string 22 incorporated in the pull tab acts to sever the first liner 28 and the corrugated medium 26 and open the panel while the other string 20 acts as a guide to produce a neat, clean separation along the line. Thus, the container 10 is opened by grasping the pull tab 18 and pulling the pull tab downward so that the cutting string 22 severs and opens the panel as it moves across the second string (FIG. 1).

It will be noted that, although the strings 20, 22 are shown between the corrugated medium 26 and the second liner 30, they could also be located in the panel at other locations in relation to the first liner 28, for example on the other side of the second liner 30. The strings may be any elongate material such as a tape or a polymeric filamentous material suitable for use at the temperature to which it will be subjected during manufacture of the corrugated fiberboard panel. A preferred material is a polyester filament provided as a thin round string having a break strength of approximately 20 pounds per 9 kilograms, and an elongation of 13–16%. The string is preferably provided on a tube for ease of application in a corrugator. The string may be coated with a hot melt adhesive suitable for use at the corrugation temperature. For example, the polyester filament may be coated with an adhesive having a softening point of 110° C. for application at a temperature greater than 110° C.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A system for separating a corrugated fiberboard panel along a separation line, comprising:

(a) a corrugated fiberboard panel having an inner liner and an outer liner with a corrugated medium sandwiched therebetween;

(b) at least two spaced-apart strings located in said panel beneath said outer liner, said strings being located on opposite sides of a separation line defined on said panel; and (c) a pull tab located in said outer liner, said pull tab being connected to at least one of said strings such that when said pull tab is pulled away from said panel and transverse to the separation line said at least one of said strings makes a cut through at least a portion of said panel, and at least one other of said strings acts as a guide to define the location of said cut.

2. The system of claim 1 wherein said strings are placed between said inner liner and said corrugated medium, and said inner liner defines a slit which is coextensive with the separation line.

3. The system of claim 2 wherein the panel is a sidewall of an enclosed container and said inner liner is on the inside of said container and said outer liner is on the outside of said container.

4. The system of claim 3 wherein the separation line extends around the periphery of said container.

5. The system of claim 2 wherein said outer liner is formed from a heavier weight material than said inner liner.

6. The system of claim 2 wherein said slit partially penetrates said corrugated medium.

7. A container, comprising:

(a) a body having a side panel interconnecting a first end panel and a second end panel, said body comprising a first liner, a second liner, and a corrugated medium located therebetween;

(b) a first string extending transversely of said side panel between said first end panel and said second end panel and located in said side panel on said second liner, said first string having a graspable end; and (c) a second guide string located in said side panel on said second liner in spaced-apart relationship to said first string, said second string lacking a graspable end.

8. The container of claim 7 wherein said second liner defines an interior of said container.

9. The container of claim 7 wherein said second string is located between said second liner and said corrugated medium.

10. The container of claim 9 wherein said second liner defines a line of weakness between said first string and said second string.

11. A container, comprising;

(a) a body having a side panel interconnecting a first end panel and a second end panel, said body comprising a first liner, a second liner, and a corrugated medium located therebetween; and (b) at least two strings located in the side panel in spaced-apart relationship between said corrugated medium and said second liner of said side panel, said strings extending transversely of said side panel between said first end panel and said second end panel, (c) wherein said second liner defines a line of weakness between and generally parallel to said at least two strings.

12. The container of claim 11 wherein said corrugated medium defines corrugations comprising ridges and grooves oriented vertically of said side panel and extending between said first end panel and said second end panel, said ridges adjacent said second liner defining a line of weakness between said at least two strings.

13. The container of claim 11 wherein one of said strings has an end, said side panel defining a pull tab including said end of said one of said strings.

14. The container of claim 11 wherein said second liner defines an interior of said container and said first liner defines an exterior of said container.

15. The container of claim 14 wherein said side panel has an edge and one of said at least two strings has an end proximate said edge, said side panel defining a first slit located between said at least two strings extending a distance from said edge and intersecting said first liner, said second liner and said corrugated medium and a second slit located adjacent said first slit extending at least said distance and intersecting said first liner, said second liner and said corrugated medium, said end of said string being located between said first slit and said second slit.

16. A container blank, comprising;

(a) a side panel interconnecting a first end panel and a second end panel, each one of said panels comprising a first liner, a second liner, and a corrugated medium located therebetween; and (b) at least two strings located between said corrugated medium and said second liner, said strings extending transversely of said side panel between said first end panel and said second end panel, (c) wherein said second liner defines a line of weakness between and generally parallel to said at least two strings.

17. The container blank of claim 16 wherein said corrugated medium defines corrugations comprising ridges and grooves oriented vertically of said side panel and extending between said first end panel and said second end panel, said ridges adjacent said second liner defining a line of weakness between said at least two strings.

18. A container, comprising:

(a) a body having a side panel interconnecting a first end panel and a second end panel, said body comprising a first liner, a second liner, and a corrugated medium located therebetween; and (b) at least two strings located in the side panel in spaced-apart relationship between said corrugated medium and said second liner of said side panel, said strings extending transversely of said side panel between said first end panel and said second end panel, (c) wherein said second liner defines the interior of said container and said first liner defines the exterior of said container, and (d) wherein said side panel has an edge and one of said at least two strings has an end proximate said edge, said side panel defining a first slit located between said at least two strings extending a distance from said edge and intersecting said first liner, said second liner and said corrugated medium and a second slit located adjacent said first slit extending at least said distance and intersecting said first liner, said second liner and said corrugated medium, said end of said string being located between said first slit and said second slit.

19. A system for separating a corrugated fiberboard panel along a separation line, comprising:

(a) a corrugated fiberboard panel having a first liner and a second liner with a corrugated medium sandwiched therebetween;

(b) at least two spaced-apart strings located in said panel, said strings being located on opposite sides of a separation line defined on said panel; and (c) a pull tab located in said panel, said pull tab being connected to at least one of said strings such that when said pull tab is pulled away from said panel and transverse to the separation line said at least one of said strings severs at least a portion of said panel to divide said at least a portion of said panel into a first section and a second section along a dividing line, and at least one other of said strings acts as a guide to define the location of said dividing line.

* * * * *